US010004373B2

(12) United States Patent
Hansen

(10) Patent No.: US 10,004,373 B2
(45) Date of Patent: Jun. 26, 2018

(54) CLEANING PAD WITH VISUALLY DISCERNIBLE INDICATOR, STEAM MOP AND METHOD

(71) Applicant: BISSELL Homecare, Inc., Grand Rapids, MI (US)

(72) Inventor: Eric J. Hansen, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 875 days.

(21) Appl. No.: 14/025,309

(22) Filed: Sep. 12, 2013

(65) Prior Publication Data

US 2014/0075710 A1 Mar. 20, 2014

Related U.S. Application Data

(60) Provisional application No. 61/701,934, filed on Sep. 17, 2012.

(51) Int. Cl.
*A47L 13/17* (2006.01)
*A47L 13/22* (2006.01)

(52) U.S. Cl.
CPC ..... *A47L 13/225* (2013.01); *A47L 13/17* (2013.01)

(58) Field of Classification Search
CPC ..... A47L 13/17; A47L 13/225
See application file for complete search history.

(56) References Cited

U.S. PATENT DOCUMENTS

| | | | | |
|---|---|---|---|---|
| 4,362,645 | A * | 12/1982 | Hof | G01K 13/002 116/201 |
| 4,681,791 | A | 7/1987 | Shibahashi et al. | |
| 6,584,990 | B2 | 7/2003 | Shaw | |
| 6,800,124 | B2 * | 10/2004 | Puntambekar | A61L 2/28 106/31.28 |
| 6,842,936 | B2 * | 1/2005 | Policicchio | A47L 13/16 15/104.94 |
| 7,144,173 | B2 | 12/2006 | Policicchio et al. | |
| 8,308,927 | B2 * | 11/2012 | Heikenfeld | A47L 13/16 15/1.51 |
| 8,458,850 | B2 | 6/2013 | Kasper et al. | |
| 9,320,405 | B2 | 4/2016 | Luedke et al. | |
| 2005/0011536 | A1 * | 1/2005 | Hofte | A47L 13/10 134/6 |

(Continued)

FOREIGN PATENT DOCUMENTS

| | | | |
|---|---|---|---|
| CN | 2482956 | Y | 3/2002 |
| JP | 05256464 | A2 | 10/1993 |
| WO | 2011019814 | A2 | 2/2011 |

OTHER PUBLICATIONS

Bissell Steam Mop™ Deluxe Model 31N1 User's Guide, 12 pages, dated 2010.

(Continued)

*Primary Examiner* — Joseph J Hail
*Assistant Examiner* — J Stephen Taylor
(74) *Attorney, Agent, or Firm* — McGarry Bair PC

(57) ABSTRACT

A cleaning pad for use with a surface cleaning appliance, such as a steam mop, includes a cleaning composition and at least one visually discernible indicator that alerts a user to the condition of the cleaning pad. The visually discernible indicator can change color as the cleaning composition is consumed.

16 Claims, 4 Drawing Sheets

(56) References Cited

U.S. PATENT DOCUMENTS

| | | | | |
|---|---|---|---|---|
| 2005/0022843 | A1* | 2/2005 | Policicchio | A47L 13/20 134/6 |
| 2005/0095053 | A1* | 5/2005 | Harris | A47L 13/22 401/138 |
| 2005/0155630 | A1* | 7/2005 | Kilkenny | A01N 37/36 134/6 |
| 2006/0008912 | A1 | 1/2006 | Simon et al. | |
| 2007/0010400 | A1 | 1/2007 | Sabnis et al. | |
| 2012/0093736 | A1* | 4/2012 | Jelonek | A47L 13/17 424/10.3 |
| 2012/0143160 | A1* | 6/2012 | Song | G01N 21/78 604/361 |
| 2012/0145191 | A1* | 6/2012 | Williams | A47L 13/17 134/6 |
| 2013/0232713 | A1* | 9/2013 | Luedke | A47L 13/225 15/228 |
| 2013/0318725 | A1 | 12/2013 | Kellis et al. | |
| 2013/0331308 | A1* | 12/2013 | Rees | C11D 3/40 510/469 |
| 2014/0075699 | A1* | 3/2014 | Krause | A47K 7/02 15/209.1 |

OTHER PUBLICATIONS

Jay M. Kellis, Surface Cleaning Apparatus, U.S. Appl. No. 13/836,630, filed Mar. 15, 2013, Acknowledgement Receipt Specification, and Figures—26 pages.

Adam Luedke, Surface Cleaning Apparatus, U.S. Appl. No. 13/788,957, filed Mar. 7, 2013, Acknowledgement Receipt Specification, and Figures—79 pages.

* cited by examiner

CLEANING PAD WITH VISUALLY DISCERNIBLE INDICATOR, STEAM MOP AND METHOD

CROSS-REFERENCE TO RELATED APPLICATION

This application claims the benefit of U.S. Provisional Patent Application No. 61/701,934, filed Sep. 17, 2012, which is incorporated herein by reference in its entirety.

BACKGROUND OF THE INVENTION

Devices such as steam mops and handheld steamers are configured for cleaning a wide variety of common household surfaces such as bare flooring, including tile, hardwood, laminate, vinyl, and linoleum, as well as countertops, stove tops and the like. Typically, steam mops comprise at least one tank or reservoir for storing liquid that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a distributor nozzle or a manifold located in a foot or cleaning head that engages the surface to be cleaned. Steam is typically applied to the backside of a cleaning pad that is removably attached to the cleaning head. Steam eventually saturates the cleaning pad and the damp pad is wiped across the surface to be cleaned to remove dirt, dust, and debris present on the surface, thereby collecting and absorbing soil and soiled cleaning composition into the pad. Additionally, auxiliary compositions, such as fragrances, detergents or other additives can be supplied via the liquid tank for distribution through the surface cleaning apparatus to improve cleaning efficacy or to provide other sensory benefits. Alternatively, these auxiliary compositions can be impregnated, embedded, encapsulated within, or otherwise affixed to the cleaning pad. Steam from the steam distributor nozzle can release the composition onto the surface to be cleaned.

Some steam appliances locate a removable water supply tank and a steam generating device on an upright handle and deliver steam through a universal joint to a pivoting cleaning foot that is typically covered by a reusable cleaning pad. One example is the BISSELL Steam Mop™ Deluxe (Model 31N1). Details of a similar steam mop device are disclosed in Chinese Patent No. CN2482956 to Wu, issued Mar. 27, 2002. In an alternate configuration, the steam generator can be located on the cleaning head as disclosed in U.S. Pat. No. 6,584,990 to Shaw, issued Jul. 1, 2003.

Pre-moistened, impregnated cleaning pads and cleaning pads that can also reabsorb liquid from a surface to be cleaned are disclosed in U.S. Pat. No. 7,144,173 to Policicchio, issued Dec. 5, 2006.

The cleaning effectiveness of the cleaning pad depends on the soil level of the cleaning pad and the presence of any auxiliary compositions which may be incorporated into the pad. During use, as the cleaning pad attracts and absorbs larger amounts of soil over time, the cleaning effectiveness can diminish. Additionally, cleaning performance of the pad can also diminish when auxiliary compositions incorporated in the pad are expended. Therefore, to maintain optimal cleaning performance, a user must frequently ascertain the condition of the cleaning pad, which generally requires manually rotating the foot of the steam mop so the user can view the cleaning pad, which is mounted to the bottom of the foot. This is a cumbersome and user-dependent operation, which does not provide sufficient visual feedback to the user in order to make accurate judgments regarding the condition of the cleaning pad.

BRIEF SUMMARY OF THE INVENTION

According to one aspect of the invention, a cleaning pad for a surface cleaning appliance includes a substrate having an absorbent layer, a consumable cleaning composition in the absorbent layer, and a color-changing indicator changing from a first color to a second color as the cleaning composition is consumed.

According to another aspect of the invention, a surface cleaning apparatus includes a foot movable along a surface to be cleaned, a handle coupled to the foot for maneuvering the foot along the surface to be cleaned, a steam generator provided on one of the foot and the handle, and a cleaning pad mounted to the foot and positioned to contact the surface to be cleaned, wherein the cleaning pad includes an absorbent layer, a consumable cleaning composition in the absorbent layer, and a color-changing indicator changing from a first color to a second color as the cleaning composition is consumed.

DESCRIPTION OF EMBODIMENTS OF THE INVENTION

Figure 1:
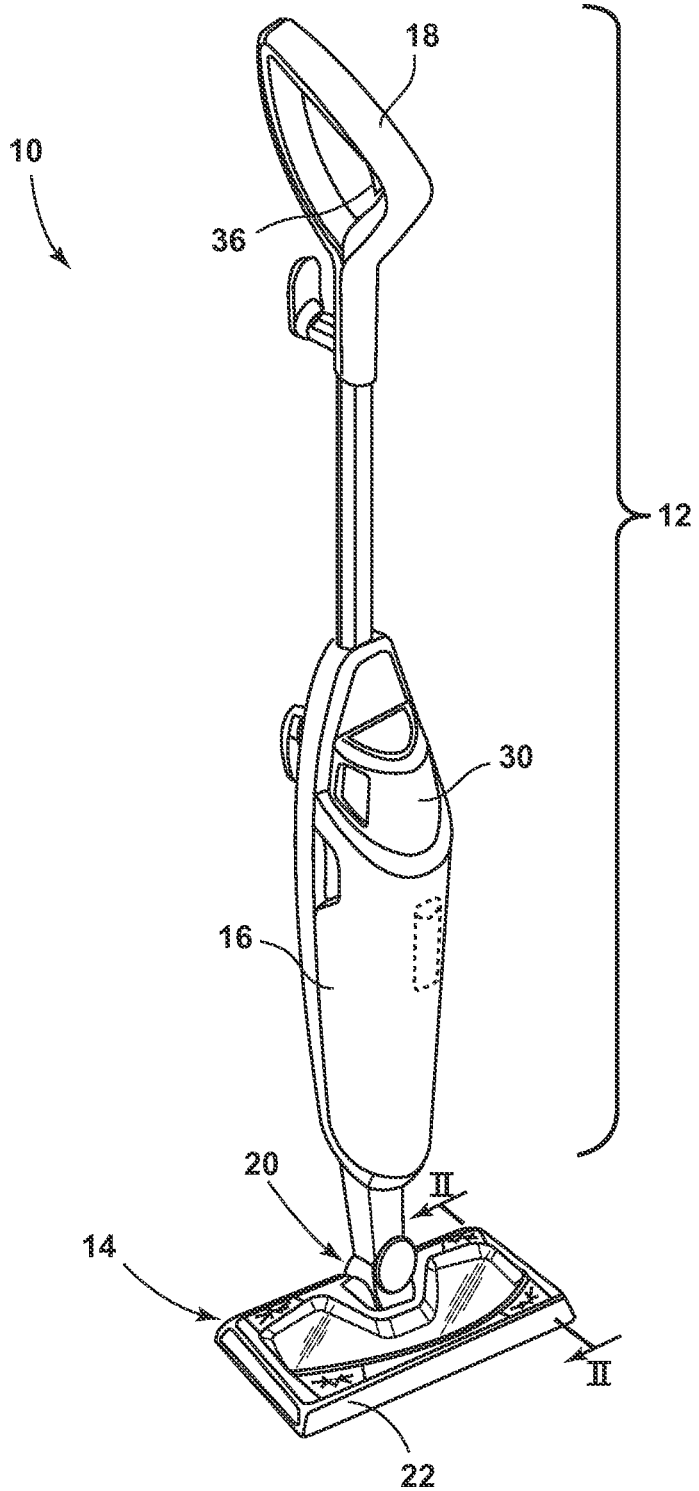
FIG. 1 is a front perspective view of a surface cleaning apparatus in the form of a steam mop according to a first embodiment of the invention.

The invention generally relates to a surface cleaning apparatus with heat and a cleaning composition delivery. Referring to FIG. 1, a steam mop 10 according to one aspect of the invention comprises an upright handle assembly 12 mounted to a cleaning foot assembly 14. The upright handle assembly 12 further comprises a handle housing 16 located between a handle grip 18 and a joint 20. The cleaning foot assembly 14 is attached to the joint 20 to moveably mount the foot assembly 14 to the handle assembly 12. In one embodiment, the joint 20 can comprise a universal joint 20, such that the foot assembly 14 can pivot about at least two axes relative to the handle housing 16.

Figure 2:
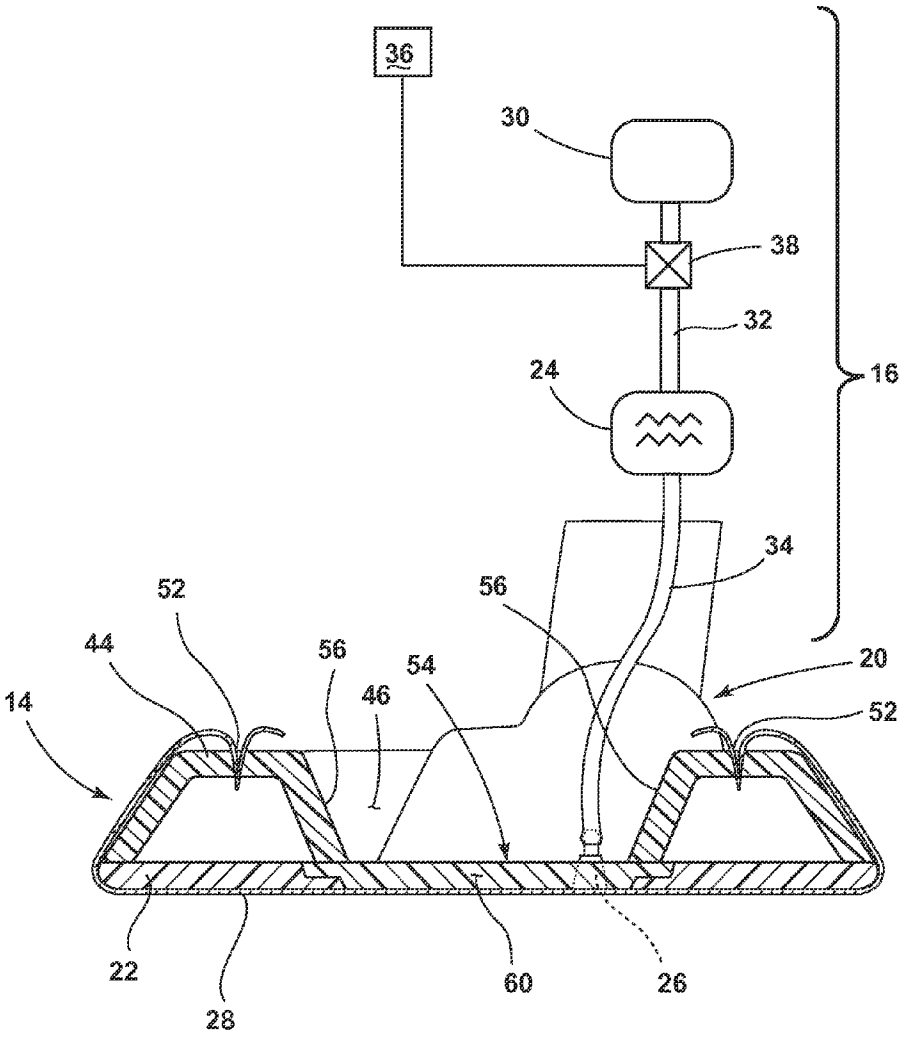
FIG. 2 is a schematic, cross-sectional view of the foot assembly of FIG. 1 taken along line II-II with the cleaning pad attached to the steam frame and portion of the fluid delivery system of the steam mop shown schematically.

With reference to FIG. 2, the foot assembly 14 further comprises a steam frame 22 and a cleaning pad 28 removably attached to a lower surface of the steam frame 22. The steam frame 22 comprises a generally rectangular housing having at least one steam outlet 26 formed therethrough for delivering steam to the top of the cleaning pad 28. The bottom of the steam frame 22 can further comprise one or more steam delivery channels (not shown) that are fluidly connected to the at least one steam outlet 26 for distributing steam to the top side of a cleaning pad 28.

The handle housing 16 further accommodates a portion of a fluid delivery system comprising a cleaning solution reservoir 30 that is configured to distribute cleaning solution to downstream portions of the fluid delivery system. Optionally, the fluid delivery system can comprise multiple solution reservoirs as more fully described in U.S. application Ser. No. 13/788,957, filed Mar. 7, 2013, titled "Surface Cleaning Apparatus", now U.S. Pat. No. 9,320,405, which is assigned to BISSELL Homecare, Inc. and incorporated herein by reference in its entirety A solution conduit 32 fluidly connects the cleaning solution reservoir 30 to a steam generator 24 for conveying liquid from the reservoir 30 into the steam generator 24. A steam conduit 34 fluidly connects the steam generator 24, through the universal joint 20, to the steam outlet 26 for conveying steam generated by the steam generator 24 onto a top surface of the cleaning pad 28 through the at least one steam outlet 26. The steam generator 24 can comprise an in-line flash heater. Alternatively, the steam generator 24 can be mounted within the foot assembly 14. Examples of suitable steam generators for mounting within the foot assembly 14 are more fully described in U.S. Pat. No. 6,584,990 to Shaw, issued Jul. 1, 2003, and U.S. application Ser. No. 13/836,630, filed Mar. 15, 2013, titled "Surface Cleaning Apparatus", now U.S. Pat. No. 9,420,933, assigned to BISSELL Homecare, Inc., which are both incorporated herein by reference in their entirety.

A trigger 36 is pivotally mounted to the handle grip 18 (FIG. 1) and is accessible for selective engagement by a user. The trigger 36 is operably coupled to a valve 38 that is fluidly connected between the solution conduit 32 and steam generator 24 for selectively controlling flow of solution from the cleaning solution reservoir 30 to the steam generator 24. In one embodiment, the trigger 36 can be connected to an upper end of a push rod (not shown) that is slidably mounted within the handle housing 16, with a bottom end of the push rod in register with the valve 38.

Additional examples of steam mops, steam mop pads and cleaning methods that may be used with embodiments of the invention described herein include the BISSELL Steam Mop™ sold in the United States by BISSELL Homecare, Inc. and International Application No. PCT/US10/45167, filed Aug. 11, 2010, published as WO2011/019814, titled "Upright Steam Mop with Auxiliary Hand Tool" and U.S. application Ser. No. 12/778,615, filed May 12, 2010, now U.S. Pat. No. 8,458,850, titled "Upright Steam Mop Sweeper" and U.S. application Ser. No. 13/788,957, filed Mar. 7, 2013, titled "Surface Cleaning Apparatus", now U.S. Pat. No. 9,320,405, and U.S. application Ser. No. 13/323,286, published as US2012/0145191, filed Dec. 12, 2011, titled "Cleaning Cloth with Encapsulated Formulation, Steam Mop and Method", all of which are assigned to BISSELL Homecare Inc. and which are herein incorporated by reference in their entirety.

Figure 3:
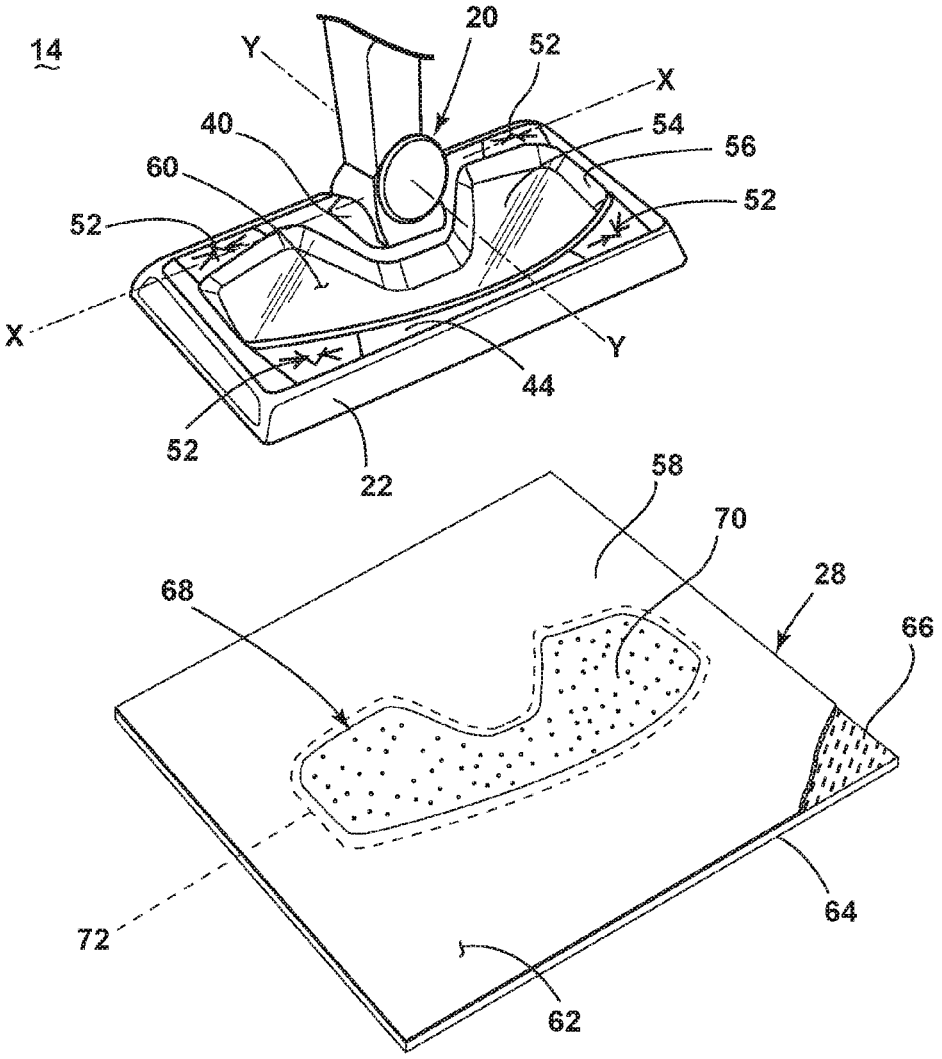
FIG. 3 is a partial exploded view of a foot assembly of the steam mop of FIG. 1.

FIG. 3 is a partial perspective view of the cleaning foot assembly 14 showing the cleaning pad 28 exploded therefrom. The universal joint 20 is pivotally mounted to corresponding bosses 40 on the upper rear portion of a cover 44, which is fastened to the top of the steam frame 22. The universal joint 20 is configured to rotate back and forth about a first horizontal axis X that extends laterally through the sides of the foot assembly 14, and from side to side about a second horizontal axis Y that extends from front to back, orthogonal to the first axis X.

As shown in FIG. 2, the cover 44 comprises a generally rectangular housing with a cutout portion 46, which forms a viewing window 54 when the cover 44 is mounted to the steam frame 22. The cover 44 can further comprise sheet retainers 52 that are configured to hold a portion of a cleaning pad 28 or cleaning sheet in register with the foot assembly 14, as is commonly known in the art. The sheet retainers 52 can be positioned outside the viewing window 54, such that the cleaning pad 28 does not obstruct the viewing window 54.

The cutout portion 46 of the viewing window 54 is bounded by a wall 56 that extends downwardly from the top surface of the cover 44 and is configured to mate against the top of the steam frame 22. The lower portion of the wall 56 defines the perimeter of the viewing window 54 for viewing the steam frame 22 and a top side 58 of the cleaning pad 28 as will be described hereinafter.

The steam frame 22 can comprise a translucent or transparent thermoplastic material such as polypropylene (PP), copolyester, polymethyl methacrylate (PMMA), acrylonitrile butadiene styrene (ABS), polycarbonate (PC) or other suitable thermoplastic materials configured to form a transparent portion 60 so that the top side 58 of the cleaning pad 28 is visible from the top of the foot assembly 14, through the viewing window 54.

Although the transparent portion 60 of the viewing window 54 has been described as being integral to the translucent steam frame 22, it is also contemplated that in an alternate configuration, the viewing window 54 can be formed by a separate window insert that is fastened to the cutout portion 46. With this configuration, the steam frame 22 could optionally be opaque.

The cleaning pad 28 can comprise a multi-layer construction. In one embodiment, the cleaning pad 28 comprises a backing layer 62, which is formed of a translucent or transparent plastic film or scrim that can be perforated to permit steam from the steam outlet 26 to pass therethrough. The backing layer 62 can at least partially define the top side 58 of the cleaning pad 28. A second, absorbent layer 64 is bonded to the backing layer 62 and can be composed of melt blown polypropylene. The absorbent layer 64 is visible through the backing layer 62 and can comprise a substantially white color. The absorbent layer 64 can become soiled during use such that the substantially white material becomes stained and discolored by the soil and soiled solution that is absorbed therein. Notably, the discoloration is visible from the top side 58 of the cleaning pad 28, through the backing layer 62, as well as the bottom of the pad 28. Thus, the level of soiling of the absorbent layer 64 can provide a user with a visual indication of the remaining useful life or cleaning effectiveness of the cleaning pad 28. From this, a user can infer how the cleaning effectiveness of the pad 28 reduces as the absorbent layer 64 becomes increasingly soiled. Optionally, the cleaning pad 28 can comprise additional layers (not shown) and can be disposable.

The cleaning pad 28 can be impregnated with a cleaning composition 66 containing a diluted formulation of a hard surface cleaning composition that is commercially available as BISSELL 2X Ultra Hard Floor Solutions Formula, which contains one or more of the following ingredients: a nonionic surfactant blend, a cationic surfactant, a fragrance and a chelating agent. In another example, the cleaning composition 66 can include a dilute hydrogen peroxide component in combination with an anionic detergent that includes an anionic surfactant such as sodium lauryl sulfate, as more fully described in U.S. application Ser. No. 13/836,630, filed Mar. 15, 2013, titled "Surface Cleaning Apparatus", now U.S. Pat. No. 9,420,933, assigned to BISSELL Homecare, Inc., which has been previously incorporated by reference in its entirety.

The cleaning pad 28 can further comprise a color-changing indicator 68 that is configured to provide visual feedback to a user and prompt the user to replace the cleaning pad 28 to maintain optimal cleaning effectiveness. The indicator 68 can change color to indicate that the cleaning composition 66 has been expended and therefore, notifies the user that the active ingredient in the cleaning pad 28 has been used up and the cleaning pad 28 should be replaced or recharged with additional cleaning composition 66.

The indicator 68 can comprise at least one localized color patch 70 located on the top of the absorbent layer 64 that is visible beneath the backing layer 62. The color patch 70 can be configured to contrast with the absorbent layer 64. For example, the color patch 70 can comprise a vibrant blue color that is visibly discernible in contrast to the substantially white background formed by the top of absorbent layer 64. The color patch 70 can be positioned on the pad 28 to align with the viewing window 54 so that a user can see the indicator 68 from the top side of the foot assembly 14.

In one non-limiting embodiment, the indicator 68 can comprise an optical state change material such as a thermochromatic dye that is configured to change color or substantially fade away when certain predetermined triggering stimuli occur. The term "thermochromatic" as used herein, describes materials that undergo an irreversible thermally-induced color change. As used herein, the term "optical state change material" is used to describe a material which is capable of existing in at least two different forms, each form possessing a unique optical state, for example, a unique wavelength resulting in a visible color or lack of color. Alternatively, the optical state change material can comprise a pH indicating dye that is configured to change color or fade away based solely on a pH change. Alternatively, the optical state change material can be configured to react with other ingredients of the cleaning composition 66 to cause a color change. For example, the optical state change material can react with a pH modifier in the composition. In another example, a surfactant in the cleaning composition 66 can solubilize the optical state change material to fade the indicator 68 to make it substantially disappear so that the absorbent layer 64 beneath the color patch 70 becomes visible. In this configuration, the optical state change material can include dyes and pigments, for example, configured to produce a desired color change.

In one configuration that will be described herein for exemplary purposes, the optical state change material (e.g. thermochromatic dye or pH indicating dye) can include at least one pH modifier that is configured to increase or decrease the pH of the dye respectively. The pH modifier can be selected and configured to be responsive to certain operational stimuli over time, such as temperature, moisture or a combination thereof. Thus, the color change of the indicator 68 can be triggered by a pH shift in the dye which can be induced by exposing the cleaning pad 28, and thus the dye, to heat, moisture or a combination thereof from the steam outlet 26 over time, during normal operation of the steam mop 10. The pH modifier can be configured to react and shift the pH when pad use exceeds predetermined operational thresholds that can coincide with the usage period in which the cleaning composition 66 is typically fully expended. Thus, the indicator 68 is capable of transforming from a first optical state to a second optical state to alert a user that the cleaning pad 28 is no longer in an optimal condition for achieving the most effective cleaning and stain removal performance. For example, the indicator 68 can shift from a vibrant blue color to white or a very light blue, or a different color altogether.

Optionally, the indicator 68 including the color state change material can be encapsulated within a degradable film 72, such as polyvinyl alcohol (PVA), that is sensitive to heat, moisture or a combination thereof. The film thickness and melt temperature can be selected to optimize the color change behavior and/or to stabilize the dye. Moreover, any one or a combination of the indicator 68, color state change material, dye, impregnated composition and pH modifier can be encapsulated within any known, suitable encapsulated dissolvable coating to achieve the desired color change results.

Non-limiting examples of thermochromatic optical state change materials include, but are not limited to the following representative examples: bromocresol green, bromocresol purple, bromophenol blue, thymolphthalein, thymol blue, aniline blue WS, durazol blue 4R, durazol blue 8G, and magenta II.

In one example, the cleaning pad 28 can comprise a cleaning composition 66 that can further comprise a non-ionic surfactant blend, a cationic surfactant, a fragrance and a chelating agent. The cleaning pad 28 can also comprise a color change indicator 68 such as thymolphtalein, for example, which is an acid-base pH indicator with a color transition range of approximately pH 9.3-10.5. So, the indicator 68 can be blue-colored when the pH of the composition is above about pH 10.5 and can be faded to a lighter blue or colorless when the pH of the composition is below about pH 9.3. The color change indicator 68 can be configured to react with one or more ingredients of the cleaning composition 66 in the presence of steam or heated liquid to change the color of the indicator 68 from a blue color to a substantially faded blue or colorless appearance, which can expose the absorbent layer 64 beneath the color patch 70, which can appear substantially white or soiled.

A method for indicating the consumption of a cleaning composition in a cleaning pad can employ the cleaning pad 28 described above in accordance with any of the embodiments of the invention. The method will be described with respect to the use of the cleaning pad 28 on the steam mop 10, but may be used with other cleaning implements that dispense fluid, such as liquid or steam.

In operation, a user prepares the steam mop 10 by filling the solution reservoir 30 with cleaning liquid, which can include a chemical composition, water, or mixture thereof. The reservoir 30 can be mounted to the handle housing 16 and fluidly connected to the solution conduit 32, which fluidly connects the cleaning solution reservoir 30 to the steam generator 24 for conveying liquid from the reservoir 30 into the steam generator 24. Upon energizing the steam mop 10, a user can selectively engage the trigger 36 to deliver liquid from the reservoir 30 into the steam generator 24, which heats the liquid passing therethrough to at least 100° C. (212° F.) to generate steam. The steam passes through the steam conduit 34 to the steam outlet 26 and is distributed to the cleaning pad 28. A portion of the cleaning composition 66 is activated and carried with the steam onto the surface to be cleaned. The cleaning composition 66 wets the surface and can optionally dwell on the surface for a specified period of time at which point the stains and debris from the surface are released into the cleaning composition 66. Excess cleaning composition 66 with the entrained stain and debris is then reabsorbed into the absorbent layer 64 of the cleaning pad 28. In addition, the steam passing through the cleaning pad 28 also contacts the indicator 68 located at the top side 58 of the cleaning pad 28.

The method for indicating the consumption of the cleaning composition 66 in the cleaning pad 28 includes changing the color of the cleaning pad 28 in response to the consumption of the cleaning composition 66. In one example, as a user continues to operate the steam mop 10, the user can look through the viewing window 54 to visually discern the indicator 68 beneath the window 54 to ascertain the condition of the cleaning pad 28, from the user's vantage point above the foot assembly 14.

The color patch 70 can change from a first color to a second color as the cleaning composition 66 is consumed, and can be responsive to at least one of the heat and moisture of the applied steam. In one specific example, over time, heat and moisture passing through the indicator 68 can trigger a pH modifier in the thermochromatic dye to react, thereby changing the pH value, which induces the color patch 70 to fade away or change color to alert the user that the cleaning pad 28 is no longer in an optimal condition to provide an adequate cleaning performance. The fading or color change of the indicator 68 can correspond to the usage timeframe necessary to substantially expend the impregnated composition 66 from the cleaning pad 28.

Additionally, as the cleaning pad 28 is used, soil, stains, and soiled composition are absorbed into the absorbent layer 64 of the cleaning pad 28, which has a substantially white appearance when new. Over time, the absorbed soil, stains and soiled composition discolor the absorbent layer 64. So, in addition to observing the changing or fading color of the indicator 68, a user can visually discern the discoloration of the soiled absorbent layer 64 through the viewing window 54 and backing layer 62 of the cleaning pad 28, which thus provides additional visual feedback regarding the condition of the cleaning pad 28 from the user's vantage point, above the top of the foot assembly 14.

Figure 4:
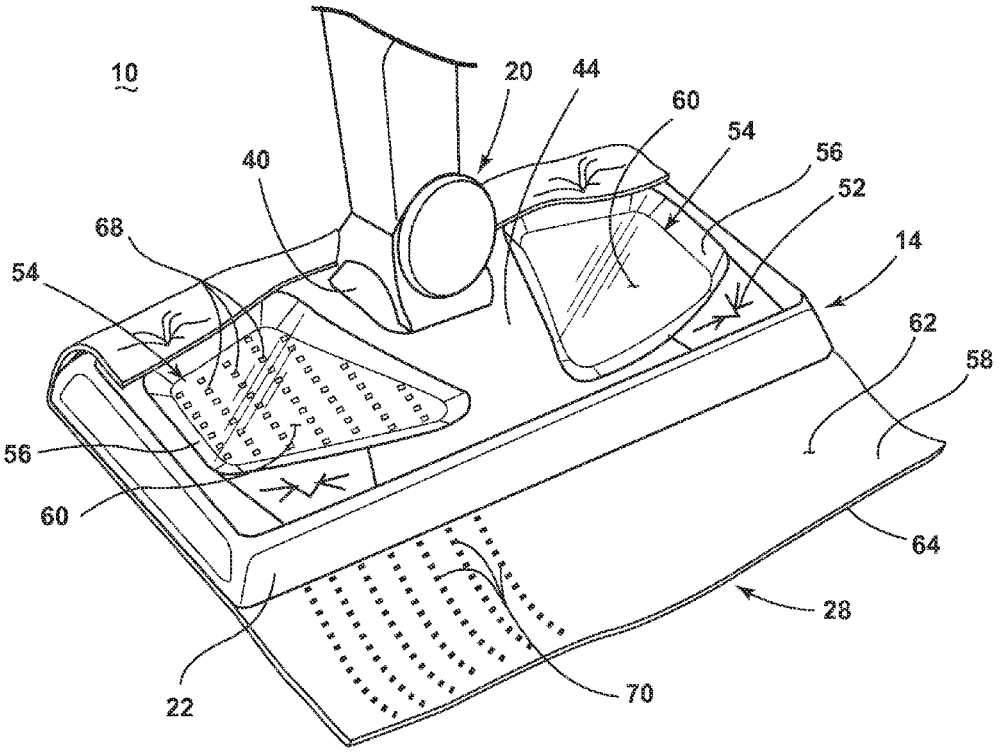
FIG. 4 is a partial front perspective view of a foot assembly of a steam mop according to a second embodiment of the invention, with a cleaning pad partially attached thereto.

FIG. 4 is a partial front perspective view of a foot assembly 14 of a steam mop 10 according to a second embodiment of the invention, with a cleaning pad 28 partially attached thereto. In the second embodiment, like elements are referred to with the same reference numerals used in the first embodiment. The steam mop 10 of the second embodiment can be substantially the same as the first embodiment, with the exception of the viewing window 54 and aspects of the cleaning pad 28. As shown, multiple viewing windows 54 can be incorporated into the cover 44 for viewing the steam frame 22 and cleaning pad 28 at multiple locations instead of the single viewing window 54 shown in FIG. 2.

For the cleaning pad 28, the indicator 68 can comprise multiple color patches 70 positioned along the top side 58 of the cleaning pad 28, underneath the backing layer 62. In the illustrated embodiment, the indicator 68 is shown extending across only a portion of the cleaning pad 28, but it is understood that the indicator 68 can extend across the entire top side 58 of the cleaning pad 28, so that color patches 70 are distributed over the cleaning pad 28. In another embodiment, the indicator 68 can be provided on discrete portions of the cleaning pad 28 aligned with the viewing windows 54. In yet another embodiment, one color patch 70 can cover the entire top side 58 of the pad 28

While the invention has been specifically described in connection with certain specific embodiments thereof, it is to be understood that this is by way of illustration and not of limitation, and the scope of the appended claims should be construed as broadly as the prior art will permit.

What is claimed is:

1. A cleaning pad for a surface cleaning appliance, comprising:

a backing layer formed of a translucent or transparent material;

an absorbent layer bonded to the backing layer, the absorbent layer impregnated with a consumable cleaning composition; and a color-changing indicator disposed between the backing layer and the absorbent layer, the color changing indicator comprising:

an optical state change material that is capable of existing in at least two different forms, a first color and a second color, in response to a change in pH; and a pH modifier that reacts in response to a change in at least one of temperature or moisture over time as the cleaning composition is consumed to increase or decrease the pH of the optical state change material as the cleaning composition is consumed to trigger a color change of the optical state change material from the first color to the second color;

wherein the pH modifier triggers the color change in the optical state change material as the cleaning composition is consumed, wherein the color change is visible through the backing layer to provide a visual indication to a user to replace the cleaning pad.

2. The cleaning pad of claim 1, wherein the color-changing indicator comprises a color patch visible through the backing layer.

3. The cleaning pad of claim 1, wherein the absorbent layer comprises melt blown polypropylene.

4. The cleaning pad of claim 1, wherein the color-changing indicator comprises the first color when the cleaning composition is present in the absorbent layer and comprises the second color when the cleaning composition is consumed.

5. The cleaning pad of claim 4, wherein the color-changing indicator fades from the first color to the second color as the cleaning composition is consumed.

6. The cleaning pad of claim 1, wherein the cleaning composition comprises one of:

(a) a dilute hydrogen peroxide component and an anionic surfactant; or (b) a non-ionic surfactant blend, a cationic surfactant, a fragrance and a chelating agent.

7. The cleaning pad of claim 1, wherein the color-changing indicator is encapsulated within a degradable film that is sensitive to at least one of heat and moisture.

8. The cleaning pad of claim 1, wherein the color-changing indicator comprises at least one color patch which contrasts with the absorbent layer.

9. The cleaning pad of claim 1, wherein the optical state change material comprises at least one of: bromocresol green, bromocresol purple, bromophenol blue, thymolphthalein, thymol blue, aniline blue WS, durazol blue 4R, durazol blue 8G, and magenta II.

10. A surface cleaning apparatus comprising:

a foot movable along a surface to be cleaned;

a handle coupled to the foot for maneuvering the foot along the surface to be cleaned;

a steam generator provided on one of the foot and the handle; and a cleaning pad mounted to the foot and positioned to contact the surface to be cleaned, wherein the cleaning pad comprises:

a backing layer formed of a translucent or transparent material;

an absorbent layer bonded to the backing layer, the absorbent layer impregnated with a consumable cleaning composition; and a color-changing indicator disposed between the backing layer and the absorbent layer, the color-changing indicator comprising:

an optical state change material that is capable of existing in at least two different forms, a first color and a second color, in response to a change in pH; and a pH modifier that reacts in response to a change in at least one of temperature or moisture over time as the cleaning composition is consumed to increase or decrease the pH of the optical state change material as the cleaning composition is consumed to trigger a color change of the optical state change material from the first color to the second color;

wherein the pH modifier triggers the color change in the optical state change material as the cleaning composition is consumed, wherein the color change is visible through the backing layer to provide a visual indication to a user to replace the cleaning pad.

11. The surface cleaning apparatus of claim 10, and further comprising at least one steam outlet provided on the foot for distributing steam to the cleaning pad.

12. The surface cleaning apparatus of claim 11, wherein the backing layer is formed of plastic film that is perforated to permit steam from the at least one steam outlet to pass therethrough.

13. The surface cleaning apparatus of claim 10, and further comprising a viewing window provided on an upper surface of the foot for viewing the cleaning pad, wherein the color-changing indicator is aligned with the viewing window and visible through the backing layer.

14. The surface cleaning apparatus of claim 10, wherein the cleaning composition comprises one of:

(a) a dilute hydrogen peroxide component and an anionic surfactant; or (b) a non-ionic surfactant blend, a cationic surfactant, a fragrance and a chelating agent.

15. The surface cleaning apparatus of claim 10, wherein the color-changing indicator comprises at least one color patch that contrasts with the absorbent layer and is visible through the backing layer.

16. The surface cleaning apparatus of claim 10, wherein the color-changing indicator comprises multiple color patches disposed between the absorbent layer and the backing layer.

* * * * *